United States Patent [19]

Goël et al.

[11] 4,155,176

[45] May 22, 1979

[54] PROCESS AND APPARATUS FOR MEASURING THE GEOMETRIC STATE OF A RAILWAY TRACK DURING CORRECTION THEREOF

[75] Inventors: Pierre Goël, Lausanne; André Jaquet, Crissier, both of Switzerland

[73] Assignee: Matisa Material Industries S.A., Lausanne, Switzerland

[21] Appl. No.: 739,199

[22] Filed: Nov. 5, 1976

[30] Foreign Application Priority Data

Nov. 7, 1975 [CH] Switzerland ..... 14402/75

[51] Int. Cl.[2] ..... G01B 11/26

[52] U.S. Cl. ..... 33/287; 33/1 Q; 33/144

[58] Field of Search ..... 33/287, 1 Q, 144

[56] References Cited

U.S. PATENT DOCUMENTS 2,531,461 11/1950 Petry ..... 33/287

3,751,169 8/1973 Fornerod ..... 33/287

FOREIGN PATENT DOCUMENTS 690440 7/1964 Canada ..... 33/1 Q

*Primary Examiner*—Richard E. Aegerter

*Assistant Examiner*—Willis Little

*Attorney, Agent, or Firm*—Wenderoth, Lind & Ponack

[57] ABSTRACT

The invention is a process and a device for measuring and registering the geometric state of a track in the course of alignment of the track with an aligning machine. The distance between a point on the already aligned track and a straight line defined by two points, one of which is on the already aligned track and one of which is on the part of the track to be aligned, is measured, and the value is registered after each alignment operation.

6 Claims, 7 Drawing Figures

A
B
C
X
X1
X2
X3
F1
F2
F3
R
R2
0

PROCESS AND APPARATUS FOR MEASURING THE GEOMETRIC STATE OF A RAILWAY TRACK DURING CORRECTION THEREOF

BACKGROUND OF THE INVENTION

The present invention concerns a process and machine for measuring and registering the geometric state of a railway track, during the course of re-alignment of the rails.

For many years machines have been known for effecting step by step rectification or alignment of the position of a railway track, as a function of a base reference defined by several points on the track; at least one of the points is found on the section of track to be aligned and at least another of the points is on the section of track which has just been rectified.

The alignment operation comprises returning the track into the position defined by the base reference when the position of said track does not correspond with the reference layout.

If necessary after alignment the track is fixed in its new position by complimentary operations, for example, by tamping of the ballast under the sleepers.

It is normal practice subsequently to plot the geometric state of the track to control or check if the alignment work has been executed in a satisfactory manner. Such a control plot for checking the geometric state of tracks can be made by means of a second machine, independent of the first, such as a rail-car or a control vehicle. This method of operating is relatively costly since two separate machines have to be used.

DESCRIPTION OF THE PRIOR ART

This control plot can be performed in a similar manner with the track aligning machine itself by effecting a second passage of the machine without carrying out any alignment but only measuring any deviations between the base reference positions and the actual position of the track. However, such second passage of the vehicle takes time and diminishes the useful working time for alignment during the often short intervals between the passage of the trains.

It has already been proposed to register the geometric state of the track after re-alignment by means of complementary measuring devices mounted behind the aligning device and directly on the track aligning machine, the devices working progressively upon progression of the aligning operations. This arrangement for the plotting of the geometric state of the track advantageously permits the use of up to two of the points of aligned track already used to define the base reference fo alignment but the third point necessary for the measuring system is then a supplementary point of the track already re-aligned. Ths distance between the different points of the measuring system is relatively long to obtain useful measuring values, and it is necessary in practice to mount a mechanism on the aligning machine and behind the aligning device, which itself is relatively long and which, by virtue of this fact, would have to be foldable for normal movement of the machine. Furthermore, the unfolding and refolding of the measuring device at the beginning and at the end of the work involves loss of time and consequently does not permit an optimum exploitation of the available intervals between the passage of trains.

To remedy this inconvenience, it has been proposed to provide a wagon which is trailed by the track aligning machine and on which wagon the mechanical device(s) are mounted, which permits using point(s) of reference on the aligned track which is(are) found outside the section of the track covered by the aligning machine. In this solution, the time of introducing into service and withdrawing from service of the measuring device at the beginning and at the end of the workings are reduced to a minimum but here also, all the inconveniences are incurred which occur with the use and the cost of two vehicles instead of one.

SUMMARY OF THE INVENTION

According to the present invention there is provided a process for the measuring and registering of the geometric state of a track in the course of alignment with an aligning machine having an aligning device which process comprises measuring the distance between a first stable point on the already aligned track and a straight line defined by two other points of the track, the first one of these two points being unstable and being situated at one side of the first stable point and in the zone of the aligning device and the second point being stable and situated at the other side of the first stable point and on the already aligned track, and registering at least one of the values of the distance measured after each aligning operation.

Also according to the invention there is provided a measuring and registering device for determining the geometric state of a track, mounted on a machine for the aligning of tracks, which device comprises three feelers for one line of track, means for effecting the continuous measurement and registration of the distance between one of these feelers and the straight line defined by the position of the other two feelers, one of the two feelers defining the straight line being mounted on the machine in the zone of the aligning device while the two other feelers of the measuring system are mounted on the machine behind the aligning device straight on points of the already aligned track, the respective feelers of the two feelers defining the reference straight line being disposed on opposite sides of the third feeler.

BRIEF DESCRIPTION OF THE DRAWINGS

The invention will be described further with reference to the accompanying drawings, showing, by way of example only, an embodiment of the invention, in which.

DESCRIPTION WITH REFERENCE TO THE DRAWINGS

Figures 1, 2:
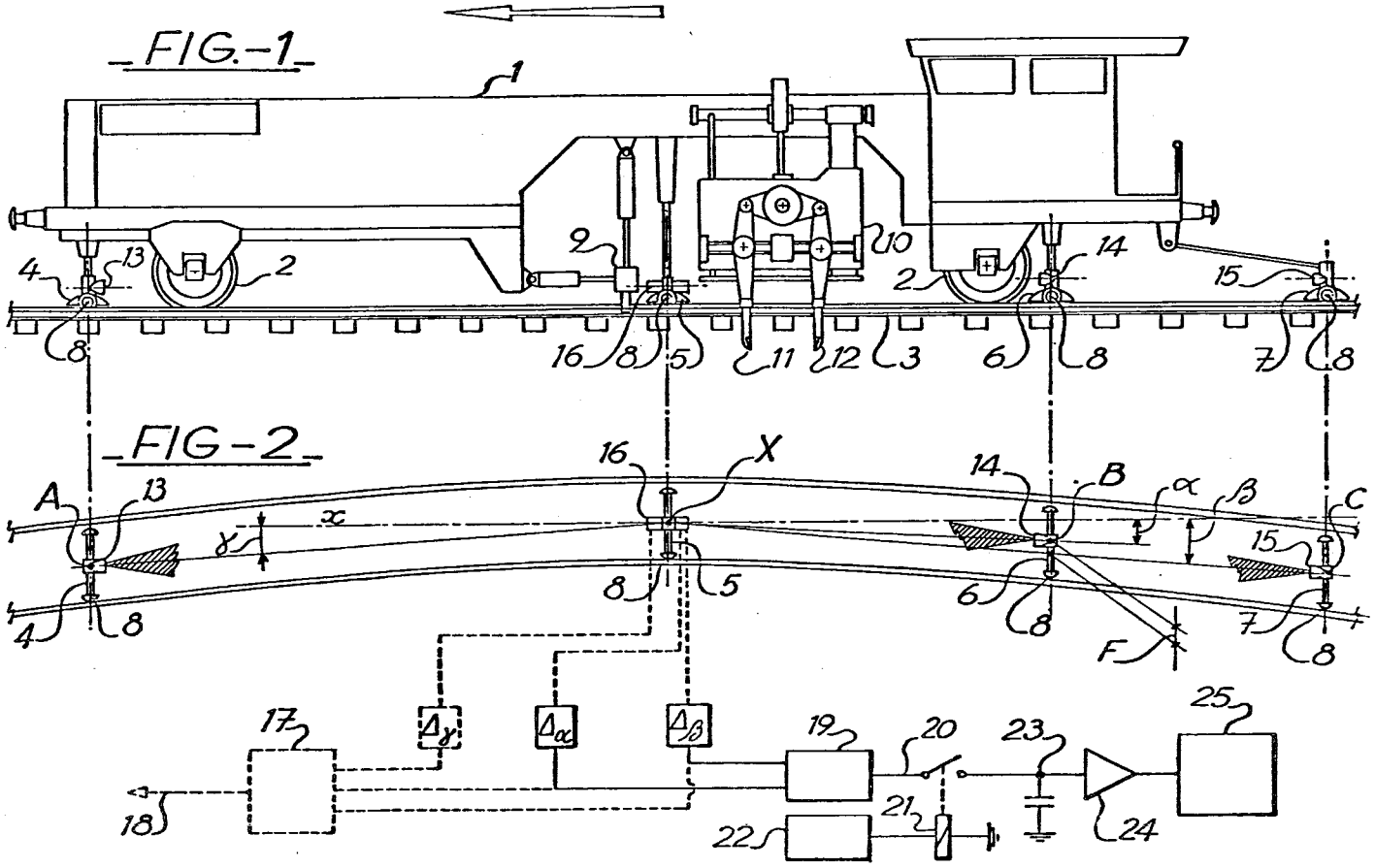
FIG. 1 illustrates a tamping-setting machine for a rail track equipped with a device permitting working in accordance with the process of the invention.
FIG. 2 is a schematic illustration of the reference device for aligning and a measuring device of such a machine.

A tamping-setting vehicle has a chassis 1 which is equipped with wheels 2 and displaceable on the rails 3 and 3' of a permanent way.

The following parts are mounted on the chassis 1 of the machine, namely:

(a) four runners 4, 5, 6 and 7, provided with feeler wheels 8 adapted to be maintained in permanent contact either with one line of rails 3 or the other line of rails 3';

(b) an aligning device 9 adapted to exert the necessary force on the rails to displace them transversely; and (c) a vertically displaceable tamping group 10 of tools including tools 11 and 12 which tamp the ballast beneath the sleepers.

The feeler wheels 8 of the runners 4, 5, 6 and 7 are maintained in contact with one line of the rails and materialize or determine the position of the points A, X, B, C, of the track.

The runner 4 (point A) is on the section of the track to be realigned. The runners 6 and 7 (respectively B and C) are on the section of track which has already been aligned. The runner 5 (point X) is at the zone of the aligning device.

The three points A, B, and C being given, it is possible by means of known devices to determine whether the point X is on the circular curve which passes through the three points A, B and C and, in the case of a deviation, obtain a control signal operating on the aligning device to cause it to bring the track back at point X to eliminate this deviation. FIG. 2 shows, by way of example, such a device (cf. U.S. Pat. No. 3,751,169). Pin-point luminuous sources 13, 14 and 15, are located on the runners 4, 6 and 7 at the points A, B and C and emit rays which are detected by an optical receiver for angular measurement 16; said receiver being located at X on the runner 5. The optical receiver simultaneously determines all the angles formed by its measuring axis (x–x') and the axis of each of the beams of light emitted from the different luminous sources A, B and C for example, the angles $\gamma$, $\alpha$ and $\beta$.

These angular measurements are processed by a calculating unit 17 which, as a function of the given distances separating the points A, X, B and C, furnishes an electric control signal for the aligning device to bring back the point X of the track on to the geometric line defined by the points A, B and C, or even for placing it in such a position beyond this line as to compensate for any recoil or spring-back R of the track after alignment in accordance with the process described in U.S. Pat. No. 3,664,265.

Figures 3, 4, 5, 6, 7:
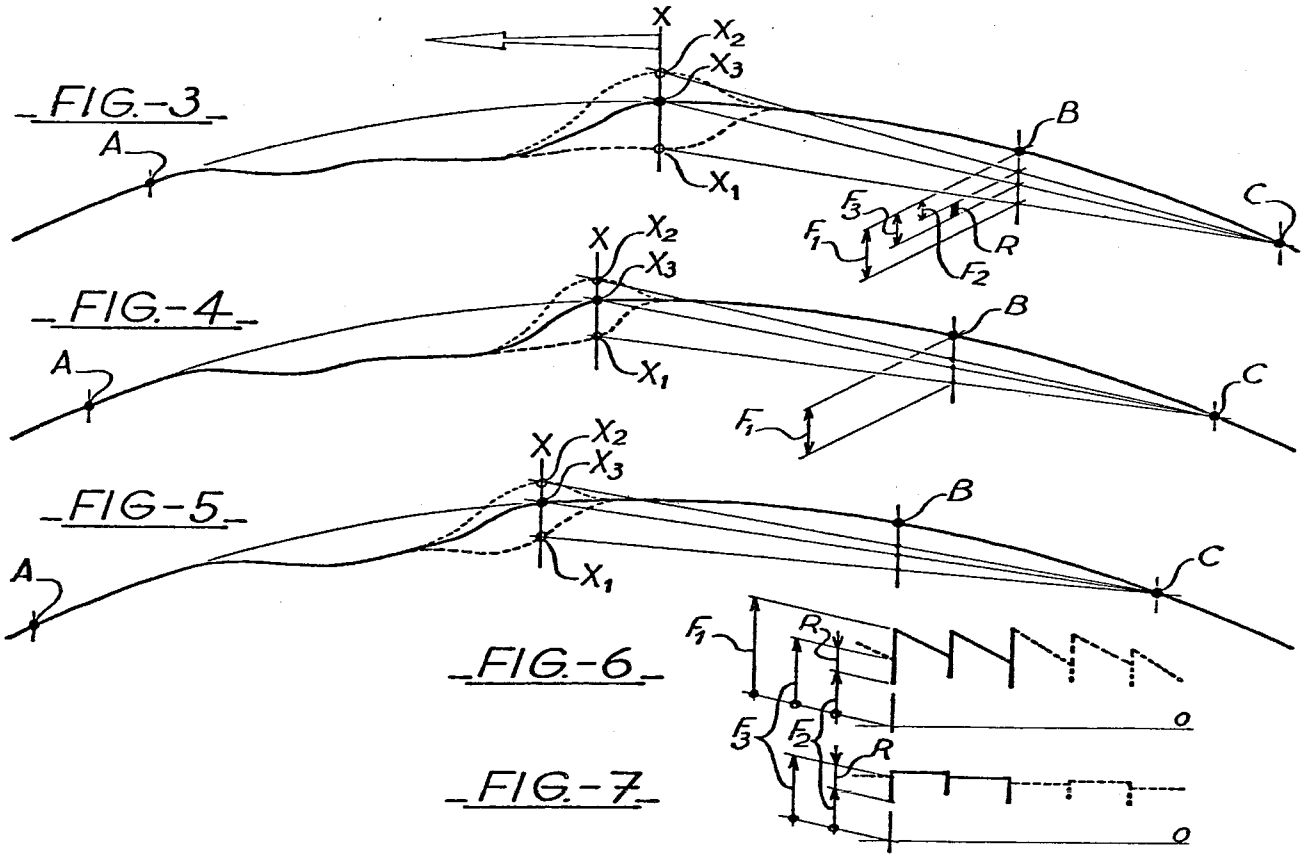
FIGS. 3, 4 and 5 schematically illustrate the operations of track alignment and the plotting measures of the geometric state of the track.
FIGS. 6 and 7 show two examples of the registration of these control measures.

At the same time, the values of the angles $\alpha$ and $\beta$ are transmitted to a second calculating unit 19 which, as a function of these values and as a function of a coefficient $\kappa$ proportional to the distances $\overline{XB}$ and $\overline{XC}$, provides an electric signal via 20 corresponding to the value of the perpendicular distance measured between the point B and the chord XC $[F=\kappa(\beta-\alpha)]$, i.e. the distance indicated by the arrows $F_1$, $F_2$ and $F_3$ in FIGS. 3, 4 and 5. This value of the distance is then transmitted by the intermediary action of an electro-magnetic relay 21 having a coil which is controlled by the control circuits 22 of the operating cycle of the machine to a sampling analog memory constituted by a capacitor 23 having very low leakage current and by an operational amplifier 24, having a very low polarization current, the output of which is connected to an electric register 25 provided with a registering band the advance of which is synchronized with that of the tamper-facer.

FIGS. 3 to 5 schematically illustrate the measurements of the geometric state of the track obtained with the device described above. On all these figures the points A, B and C, each time define and at each advance of the machine the reference curve on which the point X should be. In fact, before re-alignment, the track is at $X_1$, the alignment operation comprises bringing it back on to the reference curve or, what happens more often is that it is brought up to $X_2$ in a manner so that, once freed, it returns to $X_3$ which is the desired position on the reference curve.

It can be seen that the position of the track at $X_1$ corresponds to an arrow $F_1$ at the point B, the position at $X_2$ corresponds to an arrow $F_2$ and the position at $X_3$ corresponds to an arrow $F_3$. When the machine, after alignment at one point, advances up to the subsequent point, the arrow at the point B passes from the value $F_3$ to a new value $F_1$ which itself will become $F_2$ because of the re-alignment before re-determining value $F_3$ after springing-back of the track.

In the next step, the value of the arrow at the point B will again assume a value $F_1$ and likewise subsequently.

FIG. 6 shows the characteristic aspect of the registration which is obtained if the registration of the value of the arrows is done in a direct and continuous manner on a registration band having an advance which is synchronized with that of the machine.

The variations between the values of the arrows $F_1$, $F_2$ and $F_3$ which are produced when the machine is stationary, that is to say without the registration band being entrained, are translated on to the register by superposed vertical lines. The variations between the value of the arrow $F_3$ and of the arrow $F_1$ which are produced during the advance of the machine, that is to say when the registration band unrolls, are translated on to the register by an inclined line, the point of departure of which corresponds to the value of the arrow $F_3$ and the point of arrival of which corresponds to the next value of the arrow $F_1$, and the values of the distances $F_3$ (which could perhaps be confused with the points $F_2$ if there is no bounce back of the track) give a diagram indicative of the state of the track after alignment.

As one could, however, take exception to such a diagram as not being easily readable, it is advantageous to register the arrow F not directly but rather by the intermediary of a sampling analog memory mentioned above.

As long as the relay 21 is closed, the memory will transmit to the register in a continuous manner the variable values of the arrow—as in the case of the direct registration of FIG. 6. However, if the relay 21 happens to be interrupted, the analog memory will only transmit to the register the last value of the arrow which was communicated to it and this only as long as a new value is not communicated to it after closing of the relay 21.

One can immediately see the advantages which are presented in the case of the use of a sampling analog memory.

It suffices that after alignment and freeing of the track, the control circuits 22 of the operative cycle of the machine give, each time before the order to advance the machine, the order to close the relay 21 only for a fraction of a second. Consequently the sampling analog memory transmits to the register a constant value for the arrow F3 from the time of one order to advance the machine to the time of the next order to advance the machine. This will finally give a registration in horizontal lines—possibly in steps if the value of the arrow after alignment varies from one alignment point to the following one.

Such a diagram which corresponds to the geometric state of the track after alignment is readily readable although one might possibly regret that one might then lose the information regarding the spring-back of the track which is given by a diagram in accordance with FIG. 6. This is valuable information in the sense that it permits the machine operator to see what the values of the "surripage" or compensation are and to use such to arrive at a perfect realignment of the track.

So as not to lose this information and, moreover, to obtain a registration which is easily read, as is shown in FIG. 7, one has the advantage of controlling, by the intermediary of the control circuits of the operative cycle of the machine, the closure of the relay 21 immediately after the end of the aligning operation but before the freeing of the track and to control the opening of the same relay after the possible spring-back of the track immediately before the advance of the machine from one alignment point to the next. In this manner, the sampling analog memory during the advance of the machine and during the rectification operation, will transmit to the register the single value of the arrow $F_3$ measured finally after spring-back of the track, and then the value of the arrows $F_2$ and $F_3$ once the relay 21 is closed. The variation between the values of these arrows $F_2$ and $F_3$ will appear on the registration band (stationary like the machine during the alignment operation) in the form of a vertical line of a length proportional to the value of the spring-back of the track. The opening of the relay 21 before the advance of the machine to the following point of alignment will entrain the transmission to the registration band, by the intermediary of the sampling analog memory, of the sole value of the last arrow $F_3$ measured up to the next closing of the relay 21. One thus readily obtains a diagram which is an easily readable characteristic of the spring-back of the track and of the geometric state thereof after alignment.

The invention is not limited, of course only to the device described hereabove by way of example.

The measurement of the arrow value F at the point B with respect to the chord $\overline{XC}$ can be made by any appropriate means—as is shown, for example by the device described in U.S. Pat. No. 3,751,169.

Moreover, the invention is not limited only to the alignment of the outline of a railway track since it is also usable in the similar manner for the alignment of the level and of the profile along such a track.

What we claim as our invention is:

1. A machine for aligning a railroad track and then verifying the alignment, the machine comprising: spaced first, second and third feelers, the first feeler arranged for engagement with a section of track to be aligned and the second and third feelers being arranged for engagement with a section of track already aligned, the three feelers defining a curve of a predetermined shape indicative of a desired track location, a fourth feeler located on a section of track to be aligned between the first feeler and the second feeler, deviation determining means connected to the four feelers for determining the deviation of the fourth feeler from the curve, track aligning means located adjacent the fourth feeler, control means connected to said track aligning means and said deviation determining means for controlling the track aligning means to move the track adjacent and said fourth feeler in a direction to reduce the deviation of said fourth feeler from said curve, and measuring means to which the second, third and fourth feelers are connected for measuring and registering, after alignment and relaxation of the track at the fourth feeler, the distance of the second feeler from a straight line defined by the third and fourth feelers, whereby the aligning operation at the fourth feeler is immediately checked.

2. A machine according to claim 1 further including sampling means connected to said means for measuring and registering the distance of the second feeler from the straight line, and control circuitry connected to said deviation determining means, said track aligning means said control means, and said sampling means for controlling the operative cycle of the machine for operating the sampling means immediately after operation of said aligning means but before relaxation of the track.

3. A machine according to claim 1, further including sampling means connected to said means for measuring and registering the distance of the second feeler from the straight line, and control circuitry connected to said deviation determining means, said track aligning means said control means, and said sampling means for controlling the operative cycle of the machine for operating the sampling means immediately after operation of said aligning means and after relaxation of the track following operation of the aliging means.

4. A process for the measuring and registering of the geometric state of a track after it has been aligned with an aligning machine having an aligning device, comprising: measuring the distance between a first stable point on the already aligned track and a straight line defined by two other points of said track, the first one of these two points being on a just aligned portion of the track in the zone of the aligning device and the second point being stable and situated at the other side of the first stable point and on the already aligned track; and registering at least one of the values of the distance measured after each aligning operation of the aligning machine and measured after freeing of the track after the aligning operation.

5. A process as claimed in claim 4, in which only the single value measured after each aligning and freeing of the track is registered.

6. A process as claimed in claim 4, in which only the values measured immediately after each aligning operation and again after freeing of the track are registered.

* * * * *